US009901119B2

(12) United States Patent
Liu

(10) Patent No.: US 9,901,119 B2
(45) **Date of Patent: *Feb. 27, 2018**

(54) ELECTRONIC CIGARETTE

(71) Applicant: KIMREE HI-TECH INC., Tortola (VG)

(72) Inventor: Qiuming Liu, Huizhou (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 501 days.

This patent is subject to a terminal disclaimer.

(21) Appl. No.: 14/412,429

(22) PCT Filed: Mar. 29, 2013

(86) PCT No.: PCT/CN2013/073490

§ 371 (c)(1),
(2) Date: Dec. 31, 2014

(87) PCT Pub. No.: WO2014/153782

PCT Pub. Date: Oct. 2, 2014

(65) Prior Publication Data

US 2015/0189918 A1 Jul. 9, 2015

(51) Int. Cl.
*A24F 47/00* (2006.01)
*H05B 3/03* (2006.01)

(52) U.S. Cl.
CPC ..... *A24F 47/008* (2013.01); *H05B 3/03* (2013.01)

(58) Field of Classification Search
CPC ..... A24F 47/008; H05B 3/03
See application file for complete search history.

(56) References Cited

U.S. PATENT DOCUMENTS 8,528,569 B1 * 9/2013 Newton ..... A24F 47/008 128/202.21
8,857,446 B2 * 10/2014 Wu ..... A24F 47/008 128/202.21

(Continued)

FOREIGN PATENT DOCUMENTS

CN 102106611 A 6/2011
CN 201986689 U 9/2011

(Continued)

OTHER PUBLICATIONS

International Written Opinion.*

*Primary Examiner* — Michael J Felton
*Assistant Examiner* — Jerzi H Moreno Hernandez
(74) *Attorney, Agent, or Firm* — Cheng-Ju Chiang

(57) ABSTRACT

The present invention relates to an electronic cigarette, including an atomization device disposed with an e-liquid cup, and a mouthpiece disposed at one end of the e-liquid cup. The e-liquid cup has an e-liquid storage space. One end of the e-liquid storage space is sealed and the other end of the e-liquid storage space is open. The mouthpiece is detachably connected with an open end of the e-liquid cup. The mouthpiece of the electronic cigarette of the present invention is detachably connected with the open end of the e-liquid cup, the electronic cigarette has few components, and simple structure, and is convenient to add e-liquid.

13 Claims, 8 Drawing Sheets

(56) References Cited

U.S. PATENT DOCUMENTS 8,863,752 B2 * 10/2014 Hon ..... A24F 47/008 128/202.21
9,402,421 B2 * 8/2016 Liu ..... A24F 47/008
9,420,831 B2 * 8/2016 Liu ..... A24F 47/008
2010/0200008 A1 8/2010 Taieb
2011/0011396 A1 * 1/2011 Fang ..... A24F 47/008 128/202.21
2011/0277756 A1 * 11/2011 Terry ..... A61M 15/06 128/202.21
2012/0199663 A1 * 8/2012 Qiu ..... A61M 11/041 239/8
2013/0180533 A1 * 7/2013 Kim ..... A24F 47/008 131/273
2013/0192615 A1 * 8/2013 Tucker ..... H01C 17/00 131/328
2013/0192618 A1 * 8/2013 Li ..... A24F 47/008 131/329
2013/0263869 A1 * 10/2013 Zhu ..... A24F 47/008 131/329
2014/0109921 A1 * 4/2014 Chen ..... A24F 47/008 131/273
2014/0190503 A1 * 7/2014 Li ..... A61M 15/06 131/329
2014/0334804 A1 * 11/2014 Choi ..... A61M 15/06 392/404
2015/0189919 A1 * 7/2015 Liu ..... A24F 47/008 131/329

FOREIGN PATENT DOCUMENTS

CN 202603608 U * 12/2012
KR 101186229 B1 9/2012
KR 20120139920 A 12/2012

* cited by examiner

ELECTRONIC CIGARETTE

CROSS REFERENCE TO RELATED APPLICATIONS

The present application is a 35 U.S.C. § 371 National Phase conversion of International (PCT) Patent Application No. PCT/CN2013/073490, filed on Mar. 29, 2013, the disclosure of which is incorporated by reference herein. The PCT International Patent Application was filed and published in Chinese.

FIELD OF THE INVENTION

The present invention relates to electronic cigarettes, especially an electronic cigarette, in which a mouthpiece and an e-liquid cup are disposed to be detachably connected, thus to facilitate adding e-liquid.

BACKGROUND OF THE INVENTION

Conventional reusable electronic cigarette disposes a special cover body at an open end of an e-liquid cup, and makes the cover body and the e-liquid cup threadedly connected. When needing to add e-liquid, the cover body is unscrewed, then add e-liquid into the e-liquid cup. The electronic cigarette has many components, and the structure of the electronic cigarette is very complicated. Meanwhile, a battery of the conventional electronic cigarette electrically connects to one end of an atomization device, making the whole length of the electronic cigarette too long, and not convenient for carrying.

SUMMARY OF THE INVENTION

A problem to be solved by the present invention is to provide an electronic cigarette with simple structure, and which is convenient to add e-liquid.

To solve the aforementioned technical problems, the present invention provides an electronic cigarette, including an atomization device disposed with an e-liquid cup, and a mouthpiece disposed at one end of the e-liquid cup. The e-liquid cup has an e-liquid storage space. One end of the e-liquid storage space is sealed and the other end of the e-liquid storage space is open. The mouthpiece is detachably connected with an open end of the e-liquid cup.

Furthermore, the open end of the e-liquid cup disposes a fixed groove abutting with a corresponding end of the mouthpiece; the fixed groove disposes a liquid-filling port communicating with the liquid-storage space of the e-liquid cup.

Furthermore, the corresponding end of the mouthpiece disposes a fixed boss matching with the fixed groove to insert into the fixed groove.

Furthermore, the e-liquid cup and the mouthpiece are threadedly connected; a position of the e-liquid cup abutting with the mouthpiece disposes a first screw connection portion, and the mouthpiece correspondingly disposes a second screw connection portion to match with the first screw connection portion.

Furthermore, the first screw connection portion is a first thread ring which is disposed on one end of the mouthpiece abutting with the e-liquid cup, and the first thread ring disposes a first thread thereon; or the first screw connection portion is formed by a first thread which is directly disposed on a sidewall of the corresponding end of the mouthpiece; the second screw connection portion is a second thread ring which is disposed on a corresponding end of the e-liquid cup, and the second thread ring disposes a second thread thereon; or the second screw connection portion is formed by the second thread which is directly disposed on a corresponding sidewall of the fixed groove; the first thread and the second thread are mutually matched.

Furthermore, the fixed boss of the mouthpiece is sheathed with a sealing ring which is tensioningly fixed between the fixed boss and the fixed groove.

Furthermore, the e-liquid cup and the mouthpiece are mutually inserting connected; and one end of the mouthpiece abutting with the e-liquid cup disposes a sealing ring, and tensioningly fixed with the fixed groove by the sealing ring.

Furthermore, the end of the mouthpiece abutting with the e-liquid cup correspondingly disposes a clamping slot for clamping the sealing ring; or the clamping slot is disposed on a corresponding sidewall of the fixed groove.

Furthermore, the electronic cigarette further comprises a battery which is electrically connected with the atomization device; one end of the e-liquid cup away from the mouthpiece has a cavity body which is concave, the battery is accommodated and fixed in the cavity body.

Furthermore, the e-liquid cup comprises an outer cup body and an inner cup body; a first end of the inner cup body is hermetically connected with the outer cup body so as to matching enclose with the outer cup body to form the e-liquid storage space; a internal of the inner cup body is hollow and forms the cavity body to accommodate the battery.

Furthermore, the atomization device further comprises an atomizer disposed with a heating wire; the heating wire is electrically connected with the battery to vaporize e-liquid to aerosol when power on.

Furthermore, an external of the battery is sheathed with a battery rod; the battery rod and the e-liquid cup are disposed to be detachably connected.

Furthermore, corresponding ends of the inner cup body and the battery rod correspondingly disposes a first electrode assembly and a second electrode assembly which are used to electrically connect with the atomizer and the battery and make the e-liquid cup and the battery rod being securely abutted; the first electrode assembly includes a first seat body and a first electrode pole which are mutually insulated and respectively connects with two ends of the heating wire to form a positive electrode and a negative electrode of the atomizer; the second electrode assembly includes a second seat body and a second electrode pole which are mutually insulated and correspondingly connects to a positive electrode and a negative electrode of the battery respectively.

Furthermore, the atomizer is fixed between the mouthpiece and the battery by a supporting piece; the supporting piece is hollow tube structure, and a central of the supporting piece forms an atomization chamber for conducting an air path and accommodating the atomizer; the atomizer further includes a liquid-guiding rod with two ends thereof stretching into the e-liquid cup to absorb e-liquid; the heating wire winds on the liquid-guiding rod; a sidewall of the supporting piece correspondingly disposes a latching opening radially through the sidewall for the liquid-guiding rod passing through.

Furthermore, part or all of the outer cup body is disposed as transparent or semitransparent.

The advantage of the embodiment of the present invention are: the open end of the e-liquid cup and the corresponding end of the mouthpiece are directly disposed a connecting portion to achieve detachable connection, there are few components and the whole structure is simple; by disposing a liquid filling port at the abutting position between the e-liquid cup and the mouthpiece can achieve adding e-liquid right after separating the mouthpiece and the e-liquid cup; meanwhile, makes the battery being accommodated in the e-liquid cup, it is then effectively to reduce the whole length of the electronic cigarette; and by disposing the outer cup body of the e-liquid cup as transparent or semitransparent, it is achieved to real-time monitor on the e-liquid in the e-liquid cup, and it is convenient to add e-liquid timely.

Embodiments of the present invention will be further described in detail in the following drawings.

DETAILED DESCRIPTION OF THE INVENTION

Figure 1:
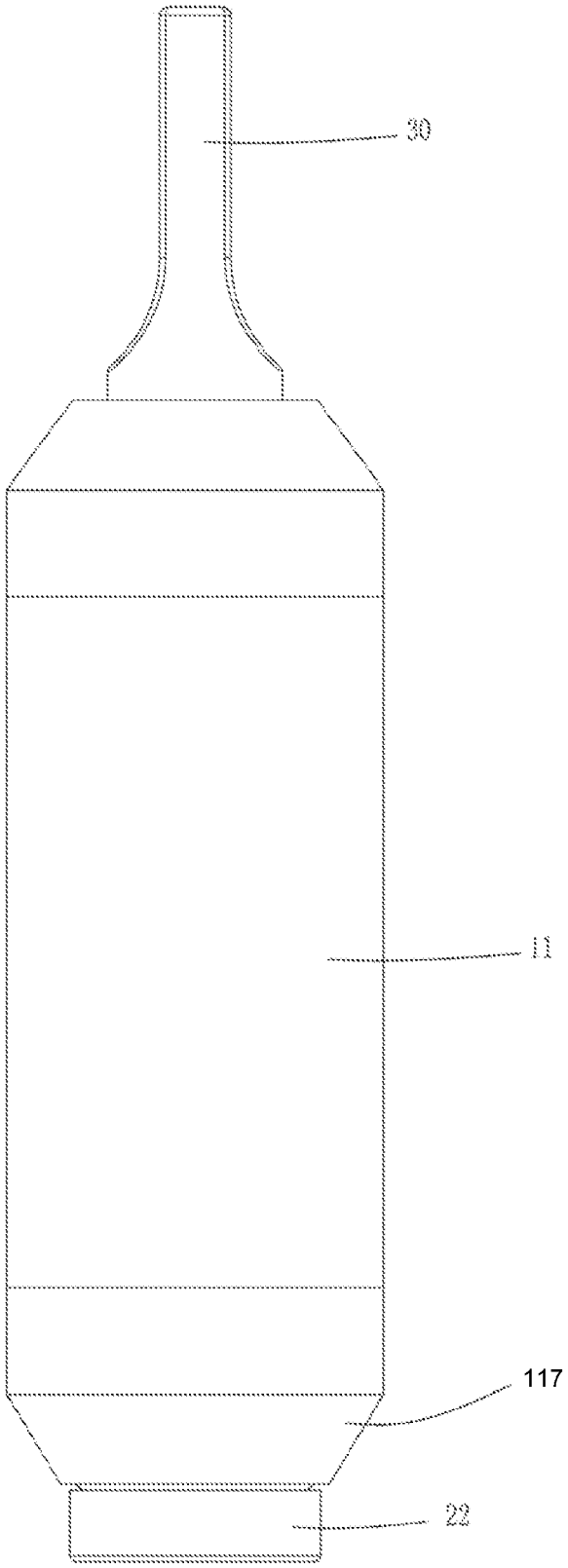
FIG. 1 is a structural schematic view of an electronic cigarette according to an embodiment of the present invention.

Referring to FIG. 1 to FIG. 8, an embodiment of the present invention provides an electronic cigarette, including an atomization device 10 (referring to FIG. 4) and a battery 20.

The atomization device 10 is used to vaporize e-liquid to aerosol, and includes an e-liquid cup 11 (referring to FIG. 7) and an atomizer 12.

In the embodiment, the e-liquid cup 11 forms a main rod body of the electronic cigarette, and disposes a liquid-storage space 111 for storing e-liquid. One end of the liquid-storage space 111 is sealed, and the other end of the e-liquid-storage space 111 is disposed as open shape for adding e-liquid. An open end of the e-liquid cup 11 disposes a mouthpiece 30 which is hermetically connected with the e-liquid cup 11. A central of the mouthpiece 30 defines an air-inhalation hole 31 to communicate with an air path for users inhaling in the aerosol produced by vaporization.

The atomizer 12 is disposed between the mouthpiece 30 and the battery 20. The battery 20 is electrically connected with the atomizer 12 to supply power to the atomizer 12.

The atomizer 12 includes a heating wire 121 and a liquid-guiding rod 122. The heating wire 121 winds on the liquid-guiding rod 122. The heating wire 121 and the battery 20 are electrically connected to vaporize e-liquid to aerosol after power on. The liquid-guiding rod 122 is made of fiberglass or other high temperature resistant fiber materials, and is used to absorb e-liquid to supply to the heating wire 121 for heating. One end portion of an air-inhalation hole 31 is mutually abutted with the atomizer 12, and a hole wall of the air-inhalation hole 31 forms a guiding channel for guiding aerosol flow thereof.

Referring to FIG. 2, FIG. 4, FIG. 5 and FIG. 7, in the embodiment, the atomizer 12 is supported and fixed between the mouthpiece 30 and the battery 20 by a supporting piece 13. The supporting piece 13 is a hollow tube structure, and a central of the supporting piece 13 forms an atomization chamber for conducting the air path and accommodating the atomizer 12.

The atomizer 12 is radially disposed in the atomization chamber. Two ends of the liquid-guiding rod 122 respectively stretch out of the atomization chamber, and then stretch into the e-liquid cup 11 to absorb e-liquid. A sidewall of the supporting piece 13 correspondingly defines a latching opening 131 radially through the sidewall thereof for the liquid-guiding rod 122 passing through.

In the embodiment, the mouthpiece 30 is detachably connected to the open end of the e-liquid cup 11.

Figure 4:
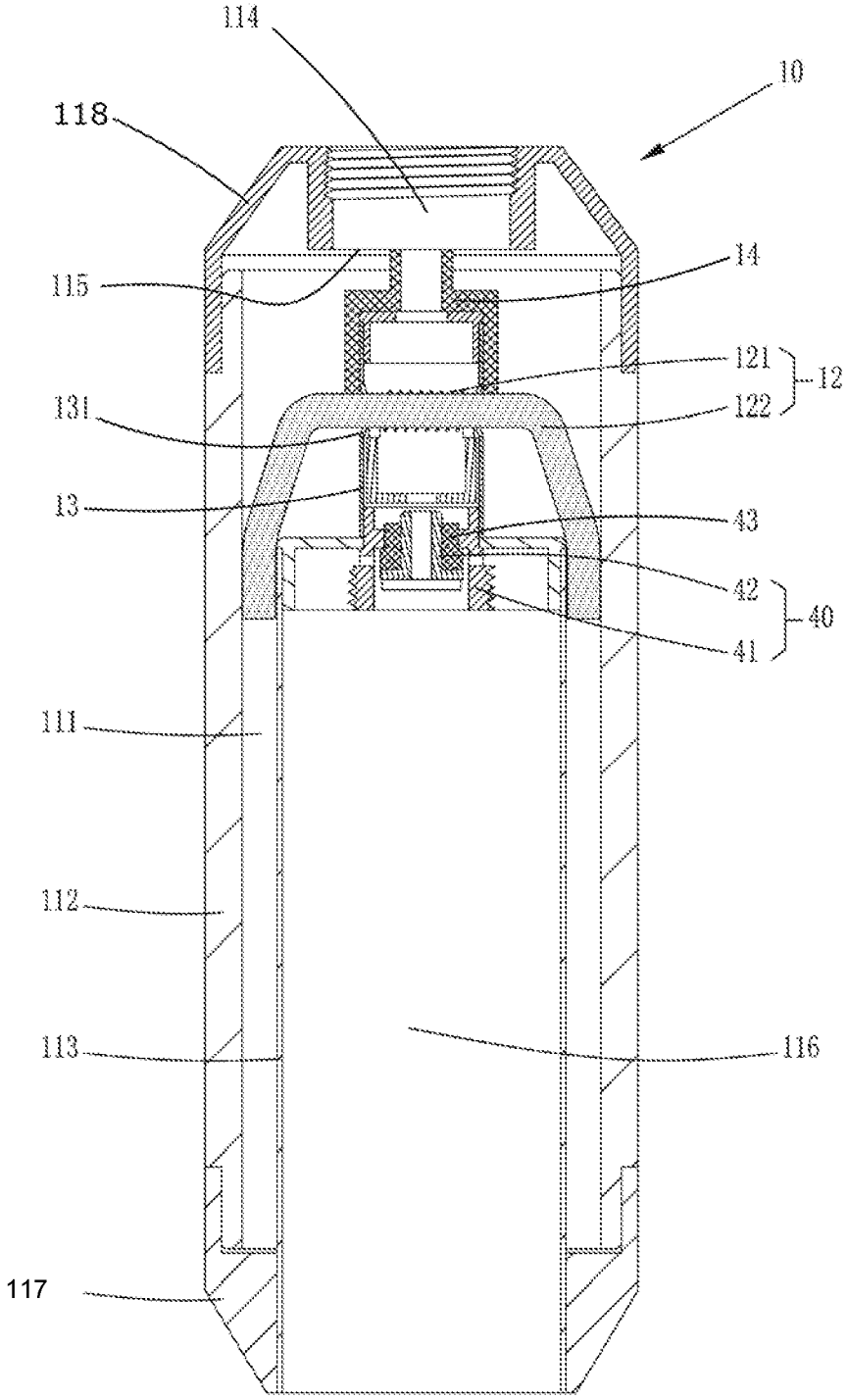
FIG. 4 is a sectional structural schematic view of an atomization device according to the first embodiment of the present invention.
Figure 7:
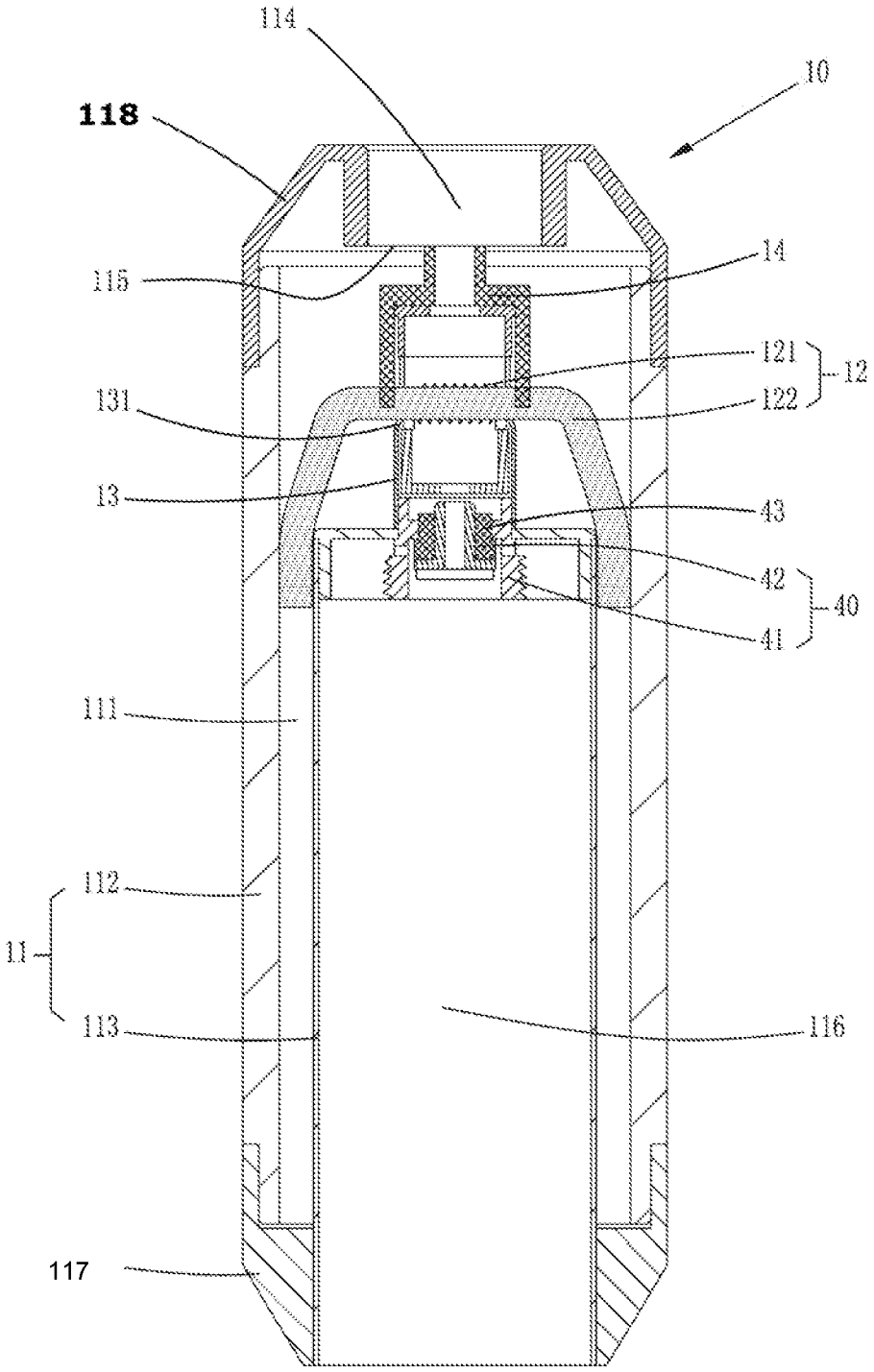
FIG. 7 is a sectional structural schematic view of an atomization device according to the second embodiment of the present invention.

Specifically, referring to FIG. 4 and FIG. 7, the e-liquid cup 11 includes an outer cup body 112 and an inner cup body 113. Both the outer cup body 112 and the inner cup body 113 are hollow tube structure. The inner cup body 113 is disposed in the outer cup body 112, and one first end of the inner cup body 113 is hermetically connected with the outer cup body 112, and one second end of the inner cup body 113 is not connected with the outer cup body 112 so as to form an opening for adding e-liquid. The outer cup body 112 and the inner cup body 113 cooperatively enclose to form an annular space, thus forming the e-liquid storage space 111.

In the embodiment, the outer cup body 112 and the inner cup body 113 are disposed as separate bodies. The first end of the inner cup body 113 and a corresponding end of the outer cup body 112 are hermetically connected by an end cover 117. Certainly, the first end of the inner cup body 113 and the corresponding end of the outer cup body 112 also may be disposed to be integrally formed.

Continue referring to FIG. 4 and FIG. 7, in the embodiment, the other end of the outer cup body 112 away from the end cover 117 is open to form an open end of the e-liquid cup 11. The other end of the outer cup body 112 (that is the open end of the e-liquid cup 11) disposes a fixed groove 114. The fixed groove 114 disposes a liquid-filling port 115 communicating with the liquid-storage space 111 of the e-liquid cup 11. A corresponding end of the mouthpiece 30 and the fixed groove 114 are securely connected and seal the liquid-filling port 115.

Figure 2:
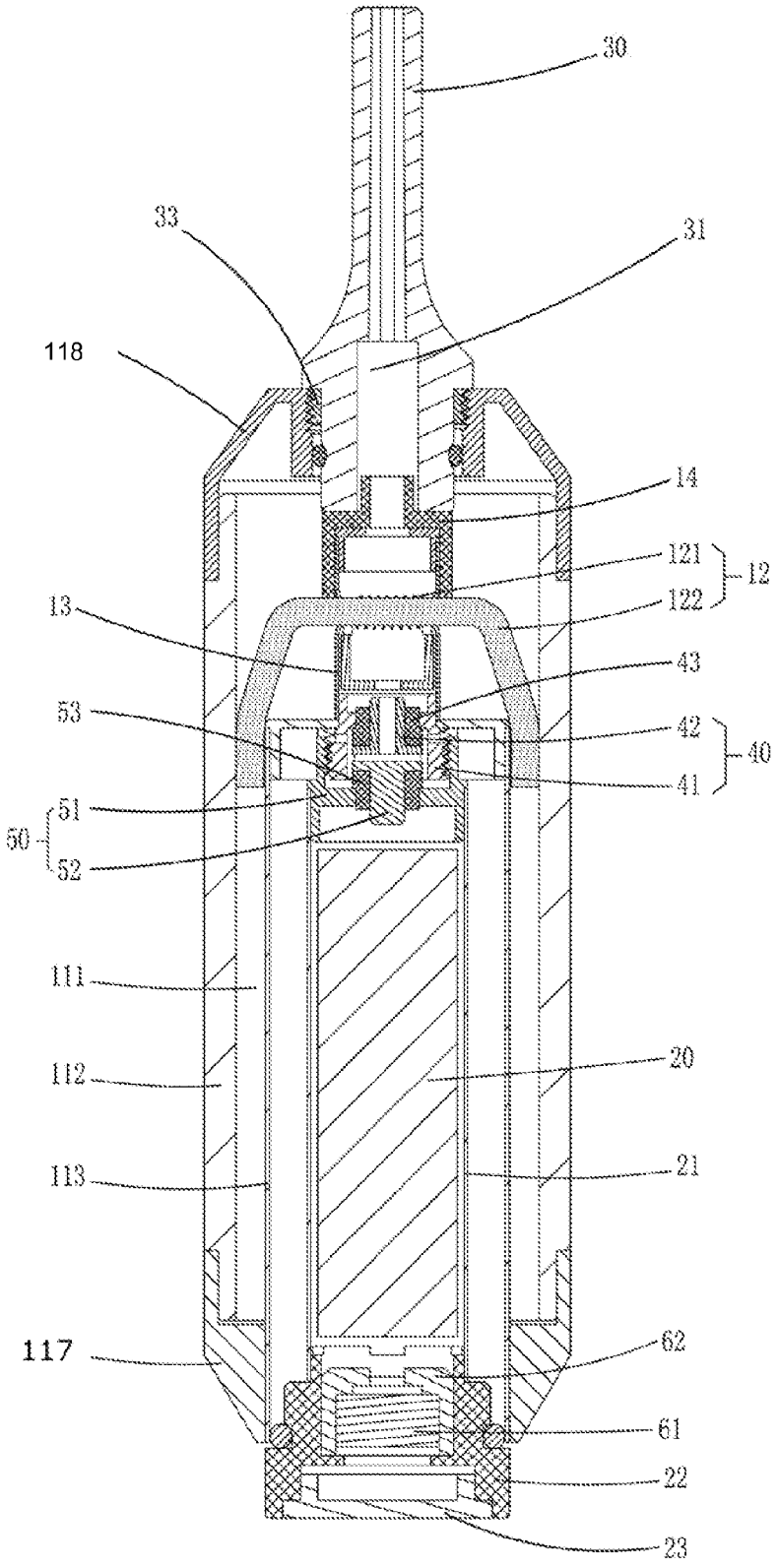
FIG. 2 is a sectional structural schematic view of an electronic cigarette according to a first embodiment of the present invention.

Referring to FIG. 2, as a preferable embodiment, the e-liquid cup 11 and the mouthpiece 30 are disposed to be threadedly connected. Specifically, a position of the e-liquid cup 11 abutting with the mouthpiece 30 disposes a first screw connection portion, and the mouthpiece 30 correspondingly disposes a second screw connection portion to match with the first screw connection portion.

Referring to the embodiment shown in FIG. 2, the first screw connection portion is a first thread ring 33 which is disposed on one end of the mouthpiece 30 abutting with the e-liquid cup 11, and the second screw connection portion is a second thread ring 118 which is disposed at a corresponding end of the outer cup body 112. The first thread ring 33 and the second thread ring 118 correspondingly dispose a first thread and a second thread which are mutually matched.

Or, as an alternative embodiment, the first thread also may be directly disposed on a sidewall of the corresponding end of the mouthpiece 30 to form the first screw connection portion, and it is not necessary to additionally dispose the first thread ring 33; the second thread also may be directly disposed on a corresponding sidewall of the e-liquid cup 11 to form the second screw connection portion, and then it is not necessary to additionally dispose the second thread ring 118.

Figure 3:
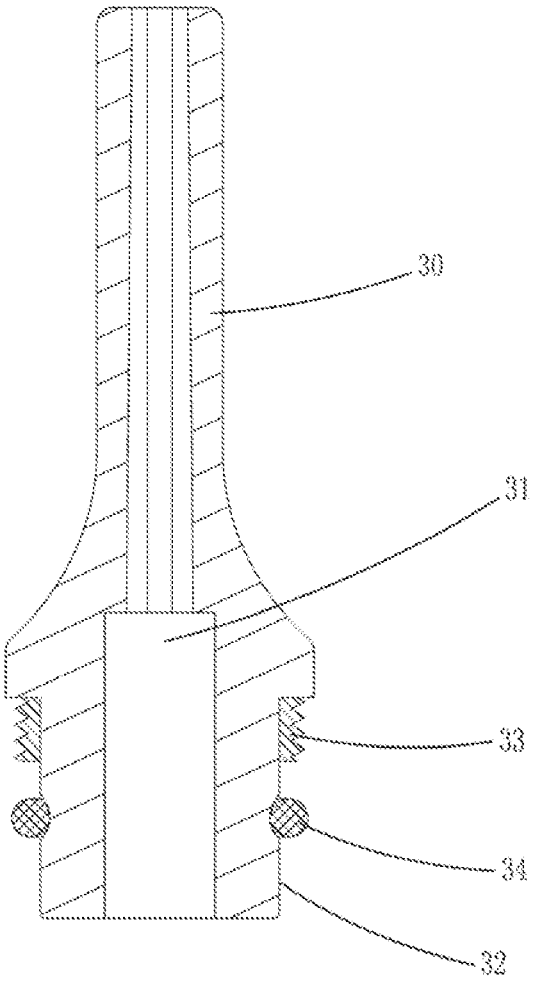
FIG. 3 is a sectional structural schematic view of a mouthpiece according to the first embodiment of the present invention.
Figure 6:
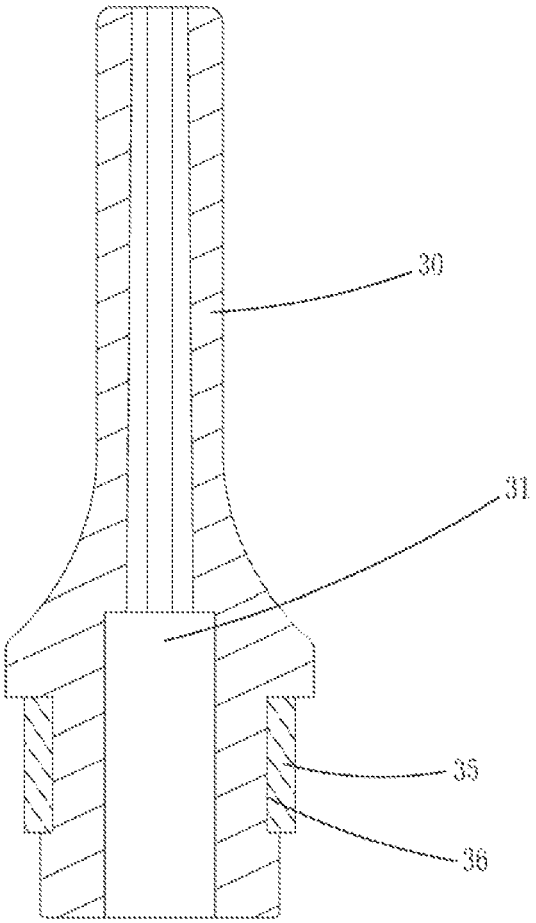
FIG. 6 is a sectional structural schematic view of a mouthpiece according to a second embodiment of the present invention.

Referring to FIG. 3 and FIG. 6, in the embodiment, a corresponding end of the mouthpiece 30 corresponding to the fixed groove 114 disposes a fixed boss 32. The fixed boss 32 matches with the fixed groove 114, making the fixed boss 32 be capable of inserting into the fixed groove 114.

Referring to FIG. 2, FIG. 3 and FIG. 4, the first thread ring 33 is sheathed on the fixed boss 32 and forms the first screw connection portion. An outer sidewall of the first thread ring 33 disposes an outer thread. The second thread ring 118 is fixed on the e-liquid cup 11 and forms the second screw connection portion. An inner sidewall of the second thread ring 118 disposes an inner thread matching with the outer thread.

In the embodiment, the fixed boss 32 of the mouthpiece 30 further disposes a sealing ring 34 thereon. The sealing ring 34 is tensioningly fixed between the fixed boss 32 and the fixed groove 114 to further guarantee the hermetical connection between the mouthpiece 30 and the e-liquid cup 11.

As another preferable embodiment, the e-liquid cup 11 and the mouthpiece 30 also may be disposed as inserting connection. Referring to the embodiment shown in FIG. 5, FIG. 6 and FIG. 7, the fixed boss 32 of the mouthpiece 30 is sheathed with a sealing ring 35. The mouthpiece 30 is tensioningly fixed in the fixed groove 114 by the sealing ring 35. In order to avoid the sealing ring 35 falling off, the fixed boss 32 correspondingly disposes a clamping slot 36 for clamping the sealing ring 35; or the clamping slot 36 also may be disposed on a corresponding sidewall of the fixed groove 114, and correspondingly fix the sealing ring 35 on the e-liquid cup 11.

In the embodiment, the inner cup body 113 away from the mouthpiece 30 defines a cavity body 116 therein. The battery 20 is accommodated and fixed in the cavity body 116. Because the inner cup body 113 is a hollow tube structure, that is to say, the hollow part of the inner cup body 113 forms the cavity body 116 being used to accommodate the battery 20.

Figure 8:
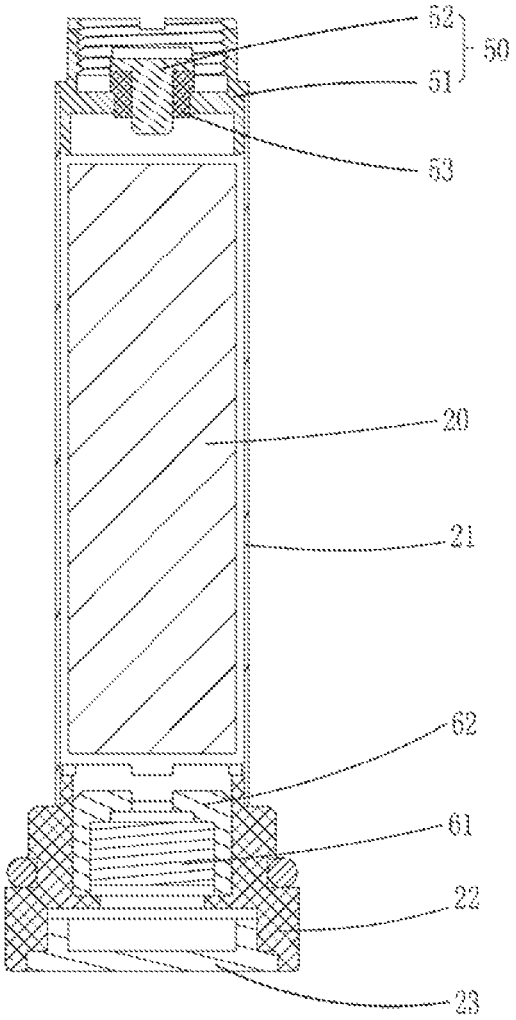
FIG. 8 is a sectional structural schematic view of a battery rod according to the second embodiment of the present invention.

Referring to FIG. 8, an outer of the battery 20 is sheathed with a battery rod 21. The battery 20 is accommodated and fixed in the cavity body 116 by the battery rod 21, and achieves electrically connection with the atomizer 12. One end of the battery rod 21 away from the atomizer 12 disposes a battery cover 22. The battery 20 is sealed and fixed in the battery rod 21 by the battery cover 22.

In the embodiment, the e-liquid cup 11 and the battery rod 21 are disposed to be detachably connected. Corresponding ends of the inner cup body 113 and the battery rod 21 correspondingly dispose a first electrode assembly 40 and a second electrode assembly 50. The first electrode assembly 40 and the second electrode assembly 50 are used to electrically connect with the atomizer 12 and the battery 20, and make the e-liquid cup 11 and the battery rod 21 being securely abutted.

Specifically, referring to FIG. 4 and FIG. 7, the first electrode assembly 40 includes a first seat body 41 and a first electrode pole 42. Both the first seat body 41 and the first electrode pole 42 are made of metal conductive material, and are insulated by a first insulation sleeve 43 disposed therebetween. The first seat body 41 and the first electrode pole 42 are electrically connected to the two ends of the heating wire 121 respectively to form a positive electrode and a negative electrode of the atomizer 12.

In the embodiment, an internal of the seat body 41 is hollow. The first electrode pole 42 uses the first insulation sleeve 43 to be tensioningly fixed in the first seat body 41 and insulated from the first seat body 41. The first electrode pole 42 is also disposed as a structure of the internal being hollow. The hollow part in the internal of the first electrode pole 42 forms an air vent for external air entering into the atomizer 10.

The second electrode assembly 50 and the first electrode assembly 40 are matching abutted, and includes a second seat body 51 and a second electrode pole 52 which are mutually insulated. Both the second seat body 51 and the second electrode pole 52 are made of metal conductive material, and correspondingly connect to a positive electrode and a negative electrode of the battery 20 respectively. A central of the second seat body 51 and the second electrode pole 52 disposes a second insulation sleeve 53, and achieves insulation by the second insulation sleeve 53. Both the second seat body 51 and the second electrode pole 52 are hollow structures. The second electrode pole 52 uses the second insulation sleeve 53 tensioningly fixed in the second seat body 51 and insulates from the second seat body 51.

Figure 5:
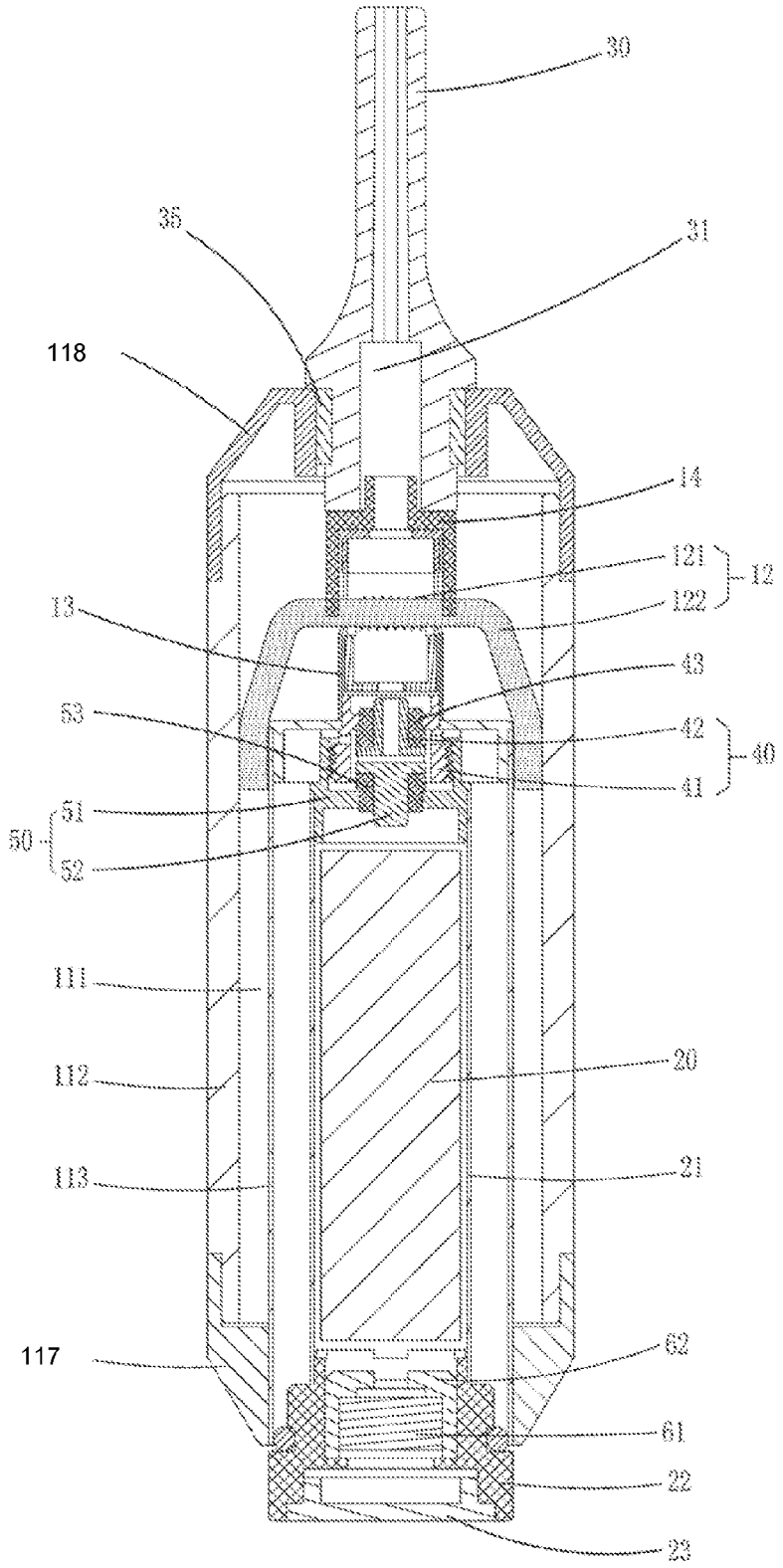
FIG. 5 is a sectional structural schematic view of an electronic cigarette according to a second embodiment of the present invention.

Referring to FIG. 2 and FIG. 5, an abutting position of the first seat body 41 and the second seat body 51 respectively disposes mutually matched thread to achieve a screw connection between the e-liquid cup 11 and the battery rod 21.

As an alternative embodiment, the e-liquid cup 11 and the battery rod 21 also may be disposed as magnetic connection. That is at the abutting position of the e-liquid cup 11 and the battery rod 21 respectively disposes a first magnetic part and a second magnetic part which are mutually magnetic attracted, making the e-liquid cup 11 and the battery rod 21 being securely abutted.

Because the first electrode assembly 40 is disposed at one end of the e-liquid cup 11 near the battery 20, and the second electrode assembly 50 is correspondingly disposed at one end of the battery 20 near the atomizer 12, and the first electrode assembly 40 and the second electrode assembly 50 are matching abutted, when specifically disposing the first magnetic part and the second magnetic part, in order to reduce components and make the structure of the electronic cigarette more simple, the first seat body 41 may be directly made of conductive magnet or magnetic material to form the first magnetic part, or the first electrode assembly 40 dispose an independent mechanism made of magnet or magnetic material to form the first magnetic part; correspondingly, the second seat body 51 also may be directly made of conductive magnet or magnetic material to form the second magnetic part, or the second electrode assembly 50 dispose an independent mechanism made of magnet or magnetic material to form the second magnetic part.

As another alternative embodiment, the first magnetic part and the second magnetic part also may be disposed at another abutting position between the e-liquid cup 11 and the battery rod 21, that is, the end cover 117 is made of magnet or magnetic material to form the first magnetic part, or the end cover 117 dispose an independent mechanism made of magnet or magnetic material to form the first magnetic part; correspondingly, he battery cover 22 is made of magnet or magnetic material to form the second magnetic part, or the battery cover 22 dispose an independent mechanism thereon made of magnet or magnetic material to form the second magnetic part.

Certainly, the e-liquid cup 11 and the battery rod 21 also may be disposed as clamping, insertion and other freely detachable connection ways.

When assembling the electronic cigarette, inserting the battery rod 21 into the cavity body 116, and fix the battery 21 in the cavity body 116 by the mutual matched connection mechanism respectively disposed on the first seat body 41 and the second seat body 51, making the first electrode assembly 40 and the second electrode assembly 50 being securely abutted, then achieve the electrically connection between the atomizer 12 and the battery 20.

Referring to FIG. 4 and FIG. 7, in the embodiment, the supporting piece 13 abuts on the first seat body 41. One end of the first seat body 41 abutting with the supporting piece 13 extends toward an internal of the supporting piece 13 to form a pillar. The supporting piece 13 is tensioningly sheathed on the pillar. The other end of the supporting piece 13 disposes a sealing sleeve 14. One end of the sealing sleeve 14 tightly abuts against the liquid-guiding rod 122, and the other end of the sealing sleeve 14 extends toward the internal of the mouthpiece 30 to form a convex column. One end of the mouthpiece 30 is sheathed on the convex column and abuts tightly to the sealing sleeve 14, achieving the sealing connection of the internal of the e-liquid cup 11 by the sealing sleeve 14, and then prevents the e-liquid in the e-liquid cup 11 leaking out from the air-inhalation hole 31. A central of the sealing sleeve 14 correspondingly disposes a conducting hole communicating with the atomization chamber and the air-inhalation hole 31 to conduct the air path.

When assembly, inserting the fixed boss 32 of the mouthpiece 30 into the fixed groove 114 of the e-liquid cup 11, using the connection mechanism disposed at the abutting position between the mouthpiece 30 and the e-liquid cup 11 to achieve matching abutting of the mouthpiece 30 and the e-liquid cup 11, until the corresponding end of the mouthpiece 30 and the sealing sleeve 14 being abutted tightly, then sealing the e-liquid storage space 111. When needing to add e-liquid, the mouthpiece 30 is removed, it is possible to add e-liquid into the e-liquid storage space 111 through the liquid filling port 115 of the open end of the e-liquid cup 11.

Meanwhile, in order to facilitate observing the balance of the e-liquid in the e-liquid storage space 111, and to add e-liquid timely to guarantee the proper use of the electronic cigarette, in the embodiment, part or all of the outer cup body 112 is disposed as transparent or semitransparent.

Referring to FIG. 2 and FIG. 5, the battery rod 21 further disposes an atomization control unit. The atomization control unit is electrically connected with the battery 20 and the atomizer 12 respectively to control the power on or power off of the atomizer 12. The atomization control unit may be disposed between the atomizer 12 and the battery 20, or disposed at one end of the battery 20 away from the atomizer 12.

In the embodiment, the atomization control unit is preferably disposed at one end of the battery 20 away from the atomizer 12, and includes an atomization control circuit and an atomization control switch which is connected with the atomization control circuit.

In the embodiment, the atomization control switch is a sensor switch 61. The sensor switch 61 is fixed in the battery rod 21 by a switch fixing seat 62. Specifically, the sensor switch 61 is a capacitive sensor switch. When users use the electronic cigarette smoking, the capacitive sensor switch sensors the change of capacity after inhaling airflow, then controls the atomization control circuit to conduct power supply, making the electronic cigarette entering into working state. As an alternative embodiment, the sensor switch 61 also may be disposed as airflow sensor switch, that is, when users inhaling by the mouthpiece 30, in the electronic cigarette generate negative pressure, then make the airflow sensor switch generating pulse signal to control the atomization control circuit to conduct the power supply.

Because a manufacturing of the sensor switch 61 is very precisely, and the sensor switch 61 usually disposes a special controller inside, so that in the embodiment the atomization control circuit may be directly integrated on the controller in the sensor switch 61. As an alternative embodiment, the atomization control circuit also may be integrated on a sensor control circuit board which is independently disposed at an external of the sensor switch 61 and electrically connected with the sensor switch 61 and the battery 20 respectively.

As an alternative embodiment, the atomization control switch also may be disposed as a traditional key control. The key switch electrically connects with the battery 20 by a key control circuit board to control the atomization control circuit by key operation, and then achieves the power on or power off of circuit of the atomizer 12.

Continue referring to FIG. 2 and FIG. 5, one end of the battery rod 21 near the battery cover 22 further disposes a lighting-emitting device. The lighting-emitting device is used as a working indicating light of the electronic cigarette, and includes a light-emitting unit which is electrically connected with the battery 20. In the embodiment, the light-emitting unit is set as a red emitting light, then when users sucking the electronic cigarette, at one end of the electronic cigarette away from the mouthpiece 30 form a red light aperture similar to that when a real cigarette burning, which improves the reality of visual sense for users. The end part of the battery cover 22 disposes a transparent or semitransparent light cap 23 for the light-emitting unit to project out light. As an alternative embodiment, the whole battery cover 22 also may be set as transparent or semitransparent.

It is understood that, the electronic cigarette of the embodiment of the present invention is not limit to the embodiments shown in FIG. 1 to FIG. 8, therein various technical features from embodiments may be combined to form new embodiments.

Embodiments of the present invention is shown and described in the above-mentioned. Various improvement and modifications can be made to the embodiments by those skilled in the art without departing from the true spirit and scope of the disclosure. The scope of the present invention is defined by the appended claims and equivalents thereof.

What is claimed is:

1. An electronic cigarette, comprising an atomization device disposed with an e-liquid cup, and a mouthpiece disposed at one open end of the e-liquid cup; the other end of the e-liquid cup being sealed as one sealed end, wherein the mouthpiece is detachably connected with the open end of the e-liquid cup;

the electronic cigarette further comprises a battery which is electrically connected with the atomization device; the sealed end of the e-liquid cup away from the mouthpiece has a cavity body which is concave, the battery is accommodated and fixed in the cavity body; the e-liquid cup comprises an outer cup body and an inner cup body; both the outer cup body and the inner cup body are hollow tube structure; the inner cup body is disposed in the outer cup body, a first end of the inner cup body is hermetically connected with the outer cup body so as to form the sealed end of the e-liquid cup, a second end of the inner cup body is not connected with the outer cup body so as to form the opening end of the e-liquid cup for adding e-liquid; the outer cup body and the inner cup body cooperatively enclose to form an annular space therebetween as an e-liquid storage space; and an interior of the inner cup body with the hollow tube structure forms the cavity body to accommodate the battery therein.

2. According to the electronic cigarette in claim 1, wherein the open end of the e-liquid cup disposes a fixed groove abutting with a corresponding end of the mouthpiece; the fixed groove disposes a liquid-filling port communicating with the e liquid storage space of the e-liquid cup.

3. According to the electronic cigarette in claim 2, wherein the corresponding end of the mouthpiece disposes a fixed boss matching with the fixed groove to insert into the fixed groove.

4. According to the electronic cigarette in claim 3, wherein the fixed boss of the mouthpiece is sheathed with a sealing ring which is tensioningly fixed between the fixed boss and the fixed groove.

5. According to the electronic cigarette in claim 3, wherein the e-liquid cup and the mouthpiece are mutually inserting connected; and the corresponding end of the mouthpiece abutting with the e-liquid cup disposes a sealing ring, and tensioningly fixed with the fixed groove by the sealing ring.

6. According to the electronic cigarette in claim 5, wherein the corresponding end of the mouthpiece abutting with the e-liquid cup correspondingly disposes a clamping slot for clamping the sealing ring; or the clamping slot is disposed on a corresponding sidewall of the fixed groove.

7. According to the electronic cigarette in claim 1, wherein the atomization device further comprises an atomizer disposed with a heating wire; the heating wire is electrically connected with the battery to vaporize e-liquid to aerosol when power on.

8. According to the electronic cigarette in claim 7, wherein an external side of the battery is sheathed with a battery rod; the battery rod and the e-liquid cup are disposed to be detachably connected.

9. According to the electronic cigarette in claim 8, wherein corresponding ends of the inner cup body and the battery rod correspondingly disposes a first electrode assembly and a second electrode assembly which are used to electrically connect with the atomizer and the battery and make the e-liquid cup and the battery rod being securely abutted; the first electrode assembly includes a first seat body and a first electrode pole which are mutually insulated and respectively connects with two ends of the heating wire to form a positive electrode and a negative electrode of the atomizer; the second electrode assembly includes a second seat body and a second electrode pole which are mutually insulated and correspondingly connects to a positive electrode and a negative electrode of the battery respectively.

10. According to the electronic cigarette in claim 7, wherein the atomizer is fixed between the mouthpiece and the battery by a supporting piece; the supporting piece is hollow tube structure, and an interior of the supporting piece forms an atomization chamber for conducting an air path and accommodating the atomizer; the atomizer further includes a liquid-guiding rod with two ends thereof stretching into the e-liquid cup to absorb e-liquid; the heating wire winds on the liquid-guiding rod; a sidewall of the supporting piece correspondingly disposes a latching opening radially through the sidewall for the liquid-guiding rod passing through.

11. According to the electronic cigarette in claim 1, wherein a part or all of the outer cup body is disposed as transparent or semitransparent.

12. An electronic cigarette, comprising:

an atomization device;

an e-liquid cup disposed in the atomization device, the e-liquid cup comprising an inner cup body and an outer cup body, and an end cover, a first end of the inner cup body and a first end of the outer cup body being hermetically connected by the end cover so as to enclose with the outer cup body to form an e-liquid storage space, one end of the e-liquid storage space being sealed by the end cover, and the other end of the outer cup body being open to form an open end of the e-liquid cup; and a mouthpiece being detachably connected with the open end of the e-liquid cup;

the other end of the outer cup body away from the end cover disposes a fixed groove, the fixed groove disposes a liquid-filling port communicating with the e-liquid storage space of the e-liquid cup, a corresponding end of the mouthpiece disposes a fixed boss matching with the fixed groove to insert into the fixed groove;

the other end of the outer cup body and the mouthpiece are mutually inserting connected;

the electronic cigarette further comprises a battery electrically connected with the atomization device and accommodated and fixed in the inner cup body, an external side of the battery is sheathed with a battery rod; the battery rod and the e-liquid cup are disposed to be detachably connected.

13. According to the electronic cigarette in claim 12, wherein corresponding ends of the inner cup body and the battery rod correspondingly disposes a first electrode assembly and a second electrode assembly which are used to electrically connect with an atomizer of the atomization device and the battery and make the e-liquid cup and the battery rod being securely abutted; the first electrode assembly includes a first seat body and a first electrode pole which are mutually insulated and respectively connects with two ends of a heating wire of the atomization device to form a positive electrode and a negative electrode of the atomizer; the second electrode assembly includes a second seat body and a second electrode pole which are mutually insulated and correspondingly connects to a positive electrode and a negative electrode of the battery respectively.

* * * * *